US007215908B2

(12) United States Patent
Facci

(10) Patent No.: US 7,215,908 B2
(45) Date of Patent: May 8, 2007

(54) NON-CONTACT BIAS CHARGE ROLL BIASED WITH BURST MODULATION WAVEFORM

(75) Inventor: John S. Facci, Webster, NY (US)

(73) Assignee: Xerox Corporation, Stamford, CT (US)

( * ) Notice: Subject to any disclaimer, the term of this patent is extended or adjusted under 35 U.S.C. 154(b) by 197 days.

(21) Appl. No.: 11/092,834

(22) Filed: Mar. 30, 2005

(65) Prior Publication Data

US 2006/0222406 A1 Oct. 5, 2006

(51) Int. Cl.
*G03G 15/02* (2006.01)
*G03G 15/00* (2006.01)

(52) U.S. Cl. ..... 399/168; 399/50; 399/89

(58) Field of Classification Search ..... 399/50, 399/89, 168, 174, 175, 176
See application file for complete search history.

(56) References Cited

U.S. PATENT DOCUMENTS 5,543,900 A 8/1996 Maebashi et al.
5,596,393 A * 1/1997 Kobayashi et al. ..... 399/174
5,613,173 A 3/1997 Kunzmann et al.
6,360,065 B1 3/2002 Ishibashi et al.
6,389,255 B1 5/2002 Sawada et al.
6,405,006 B1 6/2002 Tabuchi
6,445,896 B1 9/2002 Satoh
6,516,169 B2 2/2003 Niimi et al.
6,546,219 B2 4/2003 Sato et al.
6,560,419 B2 5/2003 Sugiura
6,628,912 B2 9/2003 Amemiya et al.
6,721,523 B2 4/2004 Sugiura et al.
6,751,427 B2 6/2004 Sugiura
6,778,797 B2 8/2004 Sato et al.
2003/0175046 A1 9/2003 Namiki et al.
2004/0109706 A1 6/2004 Kosuge et al.

* cited by examiner

*Primary Examiner*—Hoang Ngo
(74) *Attorney, Agent, or Firm*—Oliff & Berridge, PLC.

(57) ABSTRACT

A method of operating an electrostatographic printing apparatus, the apparatus including a charge-retentive member defining an imaging surface and a charging device for placing a charge on the imaging surface, a gap existing between the imaging surface and the charging device, including applying an electrical bias to the charge-retentive member by generating a burst modulated waveform.

16 Claims, 6 Drawing Sheets

| BURST RATE | CARRIER FREQUENCY | LINE | HALFTONE UNIFORMITY | PHOTO & TEXT | |
|---|---|---|---|---|---|
| 1.6 kHz NORMAL SINE (CONTROL) | | O | O | O | |
| 1.6 kHz | 2.0 kHz | O | O | O | CONSTANT BURST RATE |
| 1.6 kHz | 2.4 kHz | O | O | O | |
| 1.6 kHz | 3.2 kHz | O | O | O | |
| 1.6 kHz | 4.8 kHz | X | X | X | |
| 1.3 kHz | 1.6 kHz | O | O | O | CONSTANT CARRIER FREQUENCY |
| 1.0 kHz | 1.6 kHz | O | O | O | |

O - ACCEPTABLE
X - POOR

FIG. 6

NON-CONTACT BIAS CHARGE ROLL BIASED WITH BURST MODULATION WAVEFORM

BACKGROUND

The present invention relates to a xerographic printing apparatus, and in particular embodiments relates to a system and method for extending the useful life of a non-contact charge receptor, such as a photoreceptor, and extending the useful life of a customer replaceable unit used in the printing apparatus.

Electrostatographic printing methods, such as xerography, involve creation of an electrostatic latent image on a charge receptor, such as a photoreceptor (PR). As is well known, in such apparatus, the photoreceptor is imagewise discharged in a manner conforming to an image desired to be copied or printed, and then this latent image is developed with toner. The developed toner image is in turn transferred to a print sheet, which is then fused to fix the transferred toner image thereon.

Charging involves contact charging of a photoreceptor by a bias charge roll (BCR). Its main advantage is its low footprint. Thus it is particularly suited for charging small diameter organic photoreceptor drums (OPC) drums used in low and mid-volume black and white (B/W) and color machines. Conventional BCR charging is based on a DC-offset AC excitation waveform. As a result a stable photoreceptor charge voltage V-hi controlled by the DC bias is achieved when Vpp, the AC peak to peak voltage, is greater than a threshold voltage, V-th. Print quality considerations such as background disappearance and halftone uniformity require Vpp and $I_{AC}$ somewhat greater than the threshold values. Moreover, the trend toward increasing process speed in OPC drum based machines, particularly in tandem color applications, leads to even higher AC current requirements.

A drawback of contact AC BCR charging is the significant limitation it imposes on PR life because degradative AC corona species are generated in close proximity to the PR surface. Approaches to extend PR life include the development of hard PR overcoats and corona resistant CTL materials (e.g., PTFE filled CTLs) as well as a variety of excitation waveforms such as DC, clipped AC or pulsed bias waveforms, each with varying degrees of success. These approaches have many limitations. For example, PR degradation and wear associated with corona discharge limits the useful life of the customer replaceable unit and drives up run costs for the xerographic printing apparatus. Thus, the proximity of an AC corona discharge at the photoreceptor surface is associated with an increase in the total cost of ownership of the xerographic printing apparatus.

DC BCR charging is a very effective means of improving wear life, but BCR sensitivity to contamination by toner and PR degradation products generally precludes its practical use. Pulsed bias and clipped AC excitation waveforms have been shown to greatly improve PR wear life but a stable V-hi cannot be attained with the latter. Instead V-hi increases monotonically as V-pp and IAC increases. Thus, practical implementation of pulsed biased and clipped AC excitation waveforms would require complex controls to achieve V-hi stability especially across environmental conditions, and may be difficult to achieve.

The properties of the charge receptor, such as a photoreceptor, affect the overall functioning of a printing apparatus and the ultimate quality of images created therewith. The electrical stresses placed on a photoreceptor by printing of thousands of images contributes to the degradation of the photoreceptor. As the photoreceptor degrades the quality of images that can be created by that photoreceptor degrades as well. Thus, in practical embodiments of xerographic printers and copiers, it is inevitable that the photoreceptor will be periodically replaced. Replacement of the photoreceptor represents a large expense. It is therefore desirable to provide a method and system by which the photoreceptor, even a pre-existing photoreceptor, can be extended significantly.

Other factors that shorten the life of the bias charge rolls include toner and additive contamination. Such contamination is another cause of non-uniform charging of the BCR. Further, various methods of cleaning the BCR fail to sufficiently solve these problems. For example, contaminants in cleaners are densely impacted on the BCR surface due to the BCR loading force against the PR. These densely packed contaminants are often not removed by typical cleaning methods. Thus, even after cleaning, the effect of non-uniform charging of the BCR remains.

As BCR technology advances to include faster color machines, it is not uncommon to use higher AC currents. The use of higher AC currents in these applications typically causes an even higher wear rate of the photoreceptor. Thus, the demands of advancing technology expose even greater shortfalls associated with customer expectations regarding the usable life of a customer replaceable unit.

U.S. Pat. Nos. 5,543,900 and 5,613,173 disclose a type of charging apparatus for use in charging the photoreceptor in a xerographic printer. In combination with the bias roll which initially charges the photoreceptor a special "clipping" circuit is disclosed comprising a diode and resistor. The clipping circuit has the function of clipping an oscillating voltage applied to the bias roll, and in turn to the photoreceptor, as the bias roll charges the photoreceptor. The long-term effect of this clipping is that lower electrical stresses are experienced by the photoreceptor with extended use, and in turn the degradation of the photoreceptor is inhibited.

SUMMARY

AC current is a key contributor to PR wear. In various exemplary embodiments, PR life is improved by decreasing AC current, not by reducing Vpp, but by reducing the AC duty cycle ("on time"). In various exemplary embodiments, a "burst modulated" waveform is used for BCR charging. In other words, in various exemplary embodiments, a DC offset AC waveform is used in which an AC waveform of frequency F1 is gated on and off at a second lower frequency F2, the burst frequency. In various exemplary embodiments only the AC part of the waveform is gated off. In various exemplary embodiments the DC bias is maintained at all times. As a result, in various exemplary embodiments a stable V-hi (independent of Vpp and IAC) and the ability to set V-hi via the DC bias is achieved. The effect of various exemplary embodiments of decreasing duty cycle on print quality and the corresponding charging characteristics is plotted. In various exemplary embodiments, certain selection of the AC frequency and the gating frequency results in improved photoreceptor wear while maintaining good print quality characteristics such as good halftone uniformity and acceptably low background, and reduced run costs.

BRIEF DESCRIPTION OF THE DRAWINGS

Various exemplary embodiments of the systems and methods of this invention will be described in detail, with reference to the following figures, wherein:

FIG. 6 is a table rating performance characteristics of an exemplary image forming apparatus according to various exemplary embodiments of this invention.

DETAILED DESCRIPTION OF EMBODIMENTS

Figure 1:
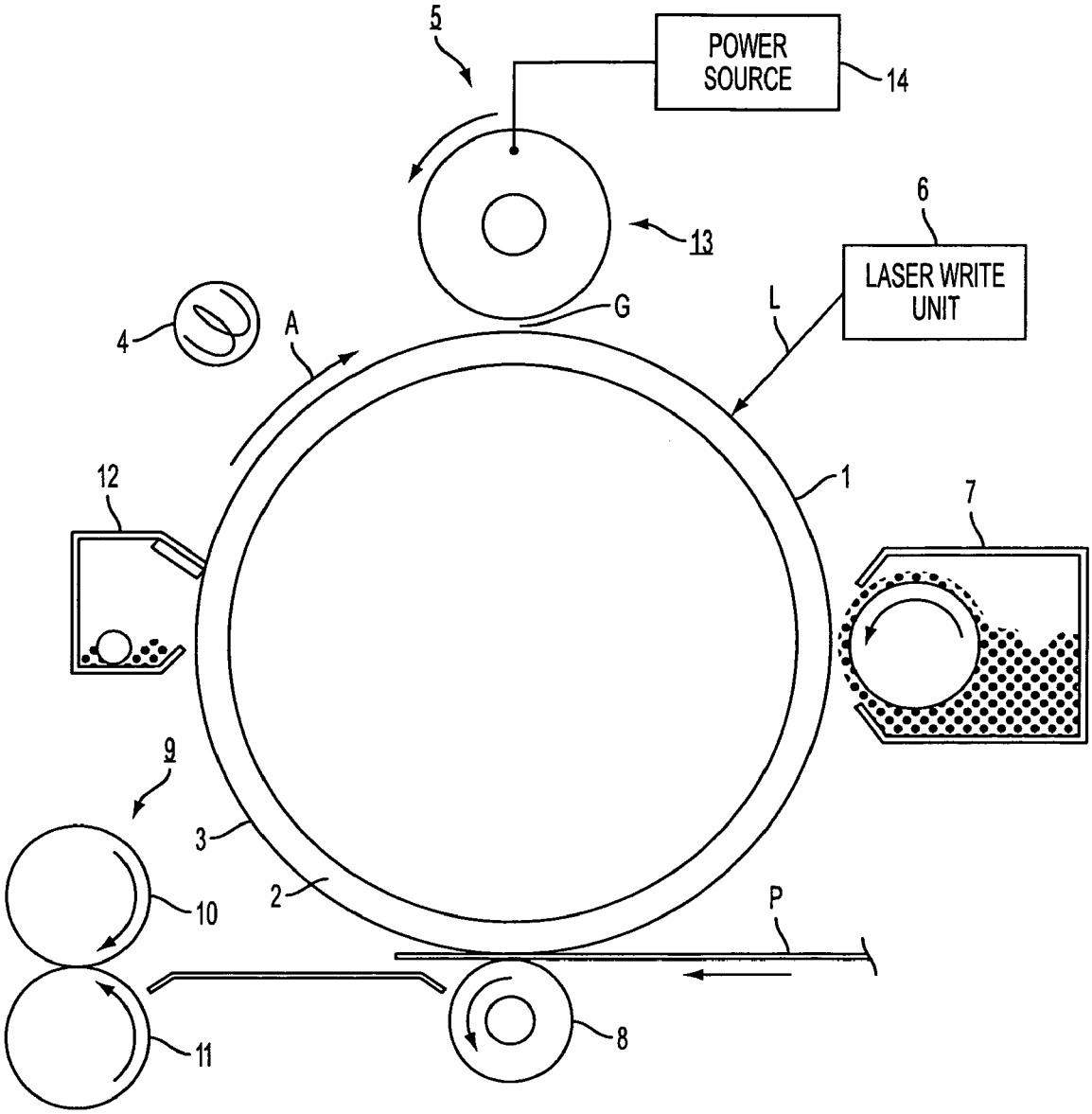
FIG. 1 is a partial cross-sectional view schematically showing an exemplary embodiment of an image formation apparatus according to this invention.

The schematic diagram in FIG. 1 shows an exemplary embodiment of an image formation apparatus with an exemplary embodiment of a charging device. The image formation apparatus is formed as a copier, a printer, a facsimile, or a multifunction machine provided with at least two of these functions. An image carrier 1 is an exemplary embodiment of a charged body and is disposed in the housing of the main body, which is not shown. This exemplary image carrier 1 is composed of a photoreceptor with a photosensitive layer 3 laminated around the peripheral surface of a conductive base 2 on its drum. In other exemplary embodiments, the image carrier is composed of a belt-like photoreceptor that is wound around a plurality of rollers to be driven, or a drum-like or a belt-like image carrier composed of a dielectric body.

In various exemplary embodiments, at the time of forming an image, the image carrier 1 is rotated in the clockwise direction in FIG. 1, and its surface moves in the direction indicated by the arrow A. At this time, the surface of the image carrier is irradiated with the light from a discharge lamp 4. The surface is initialized and charged to a predetermined polarity by the charging device 5. The charging device 5 will be explained in detail later.

The surface of the image carrier charged by the charging device 5 is irradiated with a laser beam L that is emitted from a laser write unit 6, an exemplary embodiment of an exposing device, and is subjected to light modulation. With this irradiation, an electrostatic latent image is formed on the surface of the image carrier 1. This electrostatic latent image is then visualized as a toner image by toner charged to a predetermined polarity when passing through a developing device 7.

On the other hand, a transfer material P such as, for example, a transfer paper, is fed at a predetermined timing between the image carrier 1 and a transfer device 8 disposed opposite to the image carrier 1. At this time, the toner image formed on the image carrier 1 is electrostatically transferred onto the transfer material P. The transfer material P with the toner image transferred then passes through between a fixing roller 10 of a fixing device 9 and a pressure roller 11. During this passage, the toner image is fixed onto the transfer material P by the action of, for example, heat and pressure. The residual toner after transfer remaining on the surface of the image carrier 1 without being transferred to the transfer material P is removed by a cleaning device 12.

In various exemplary embodiments, the charging device 5 comprises a charging member 13 disposed opposite to the surface of the movable charged body, that is, the surface of the image carrier 1 in the exemplary embodiment shown, and a power source 14 that applies a voltage to the charging member 13. A voltage is applied to the charging member 13 by this power source 14 to produce electric discharge between the charging member 13 and the surface of the image carrier 1, and the surface of the image carrier 1 is charged to a predetermined polarity.

In various exemplary embodiments the charging member 13 is structured in any of various types as explained later. The exemplary charging member 13 shown in FIG. 1 is cylindrically formed, and the overall member is made of metal such as stainless steel or a conductive elastomer. When charging the charged body, the charging member 13 is, in various exemplary embodiments, positioned in a non-contact state with respect to the surface of the charged body. In other exemplary embodiments, the charging member is positioned in contact with the surface of the charged body. The exemplary charging member 13 shown in FIG. 1 is disposed opposite to the surface of the image carrier 1 spaced by a fine gap G of 10 μm to 150 μm between the two.

In various exemplary embodiments, a voltage obtained by superposing an AC voltage on a DC voltage is applied to the charging member 13, and the surface of the image carrier 1 is charged to the same potential as the applied DC voltage. In various exemplary embodiments the superposed voltage of the DC voltage and the AC voltage is applied to the charging member 13 to produce electric discharge between the charging member 13 and the surface of the charged body, and charge is applied to the charged body. As explained above, by applying not only the DC voltage but also the AC voltage, in various exemplary embodiments the charge uniformity on the surface of the image carrier 1 is increased. However, the increase in the charge uniformity can be limited.

To solve this limitation, in the exemplary charging device 5, a frequency f (Hz) is set so as to satisfy $f\ (Hz) \geqq 40\ (1/mm) \cdot v\ (mm/sec)$ where the frequency of the AC voltage to be applied to the charging member 13 is f (Hz) and the movement rate of the surface of the charged body, that is, the surface of the exemplary image carrier 1, is v (mm/sec). In various exemplary embodiments, as will be explained in more detail later, by setting the frequency f (Hz) to such a value, it is possible to effectively reduce charge unevenness on the surface of the image carrier 1, further increase charge uniformity on its surface, eliminate density unevenness of the toner image, and enhance the image quality.

In the exemplary charging device 5, a peak-to-peak voltage Vpp of the AC voltage to be applied to the charging member 13 is set to a value that is twice or more the charge start voltage of the charged body. With this value, charge uniformity on the surface of the image carrier 1 is more reliably increased. As already mentioned above and also explained in detail in Japanese Patent Application Laid-Open No. 63-149669, in various exemplary embodiments the charge start voltage of the charged body is an absolute value of such a voltage at the instant when the charged body starts to be charged through application of only the DC voltage to the charging member 13 and gradually increases the absolute value of the applied voltage.

In various exemplary embodiments the charging member 13 is disposed in a non-contact state, that is, spaced by the fine gap G from the surface of the image carrier 1. When the gap G is 100 μm and the movement rate v (mm/sec) of the surface of the image carrier 1 is 200 mm/sec, the peak-to-peak voltage Vpp of the AC voltage to be applied to the charging member 13 is set to 3 KV, for example, and the frequency f (Hz) of the AC voltage is set to 8 KHz. Further, in various exemplary embodiments the DC voltage Vd(V) to be applied to the charging member 13 is set to −800 V. Based on these settings, in various exemplary embodiments the surface of the image carrier is uniformly charged to −800 V.

As explained above, when the entire charging member 13 is made of metal, in various exemplary embodiments the surface of the image carrier 1 is also charged uniformly. When charge unevenness occurs on the surface of the image carrier 1, spot-like or linear-shaped density unevenness appears on an image particularly when a developed toner image is a half-tone image, which causes the image quality to be degraded. However, in various exemplary embodiments it is possible to effectively suppress the occurrence of such density unevenness.

In various exemplary embodiments the charging member is structured in any manner other than the exemplary embodiment shown in FIG. 1, and the structure is applied for any of the other embodiments of the charging member.

Figure 2A:
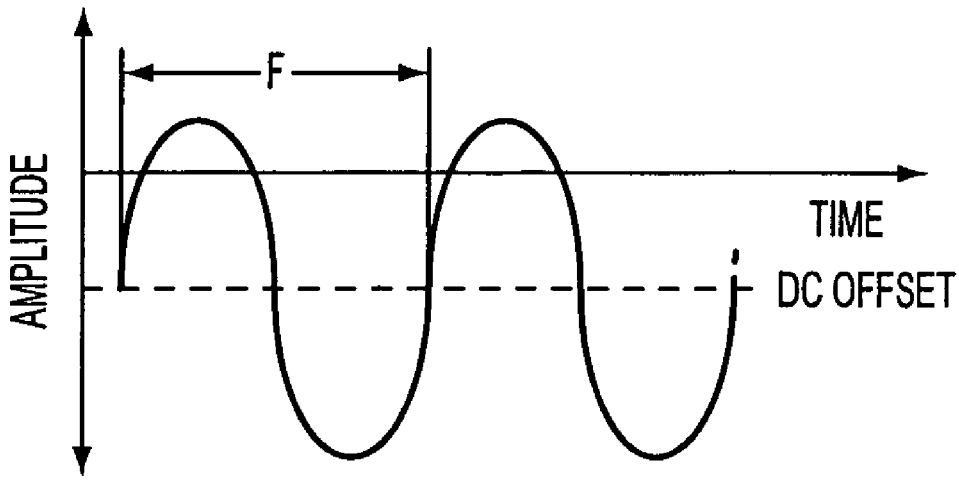
FIGS. 2A and 2B are graphs showing exemplary embodiments of Vhi-Vpp and Vhi-IAC characteristics for sinusoidal and burst modulated BCR charging.

FIG. 2A shows an exemplary embodiment of a sinusoidal AC BCR excitation wave. This wave was used in BCR print tests in an exemplary embodiment of an image forming apparatus, the DC12 machine (cyclic color engine, process speed 220 mm/sec, 48 ppm). In the exemplary B-zone, the DC offset is −570 V, Vpp=2.0 kV, IAC=3.5 mA and F=1.6 kHz.

Figure 2B:
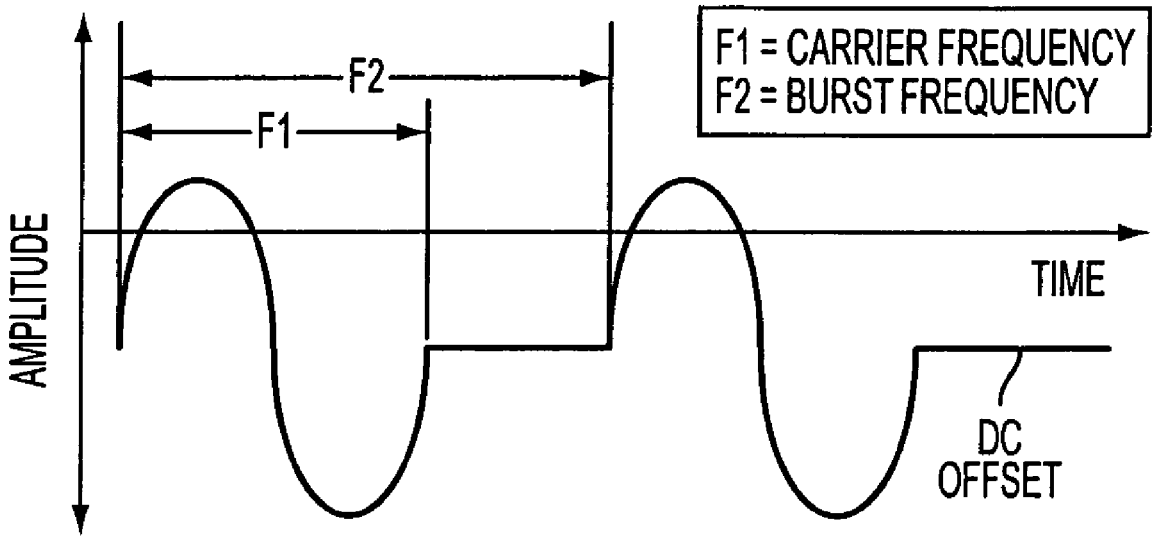

FIG. 2B shows an exemplary embodiment of a burst modulated waveform. Superimposed on a DC bias is an AC waveform at a carrier frequency F1 (period T1) that is gated on and off at a second frequency F2 (and period T2), the burst frequency. The ratio of AC on time T1=1/F1 to the burst period T2=1/F2 is defined as the AC duty cycle.

In various exemplary embodiments any number of cycles of the AC waveform is present. In various exemplary embodiments a feature of the waveform is that the AC waveform is gated off while maintaining the DC bias, during which time the AC current is zero. As a result, in various exemplary embodiments an improvement is achieved because the average AC current is decreased relative to sinusoidal BCR charging where the AC waveform is always on.

In various exemplary embodiments, the length of the time period during which the AC bias is applied and the length of the time period during which the AC bias is gated off are of the same length or are of a similar length. As a generalized nomenclature used herein, the burst modulated waveform includes any number of integral or non-integral AC cycles interrupted by any arbitrary off time.

In various exemplary embodiments, the burst modulated AC waveform is offset from 0 volts by a predetermined DC offset voltage. Thus, in various exemplary embodiments, during the period of time when the AC waveform is gated off, the bias applied to the BCR is equal to the DC offset voltage. Also, when the AC waveform is gated off, the AC corona is not generated. This results in a corresponding reduction in the period of time during which degradation associated with the AC corona does not take place.

In various exemplary embodiments, the period of time during which the AC waveform is gated off is short. In various exemplary embodiments, the period of time during which the AC waveform is gated off ranges between 0.2 and 0.4 milliseconds. Thus, in these exemplary embodiments, the photoreceptor does not advance very far during the period of time when the AC waveform is gated off. For example, at the process speed of the exemplary DC 12 machine (48 ppm, 220 mm/sec) the photoreceptor advances approximately 0.04 to 0.08 mm during 0.2 to 0.4 milliseconds.

Further, it is believed that ions within the corona persist in the gap between the bias charge rollers and the photoreceptor for some short period of time after the AC corona is gated off. It is believed that the DC bias on the BCR during the short period of time when the AC corona is gated off accelerates residual negative ions in the gap towards the photoreceptor. Thus, it is believed that the charging process does not completely shut off during the short period of time when the AC bias is gated off by the waveform in various exemplary embodiments. It is believed that this effect assists in keeping the charging of the photoreceptor uniform.

Advantages of the exemplary embodiments described above include the adherence of burst modulated BCR charging to various design rules associated with BCR charging behavior such as charging the BCR to a stable voltage at or near the DC offset voltage with roughly the same Vpp.

Figure 3A:
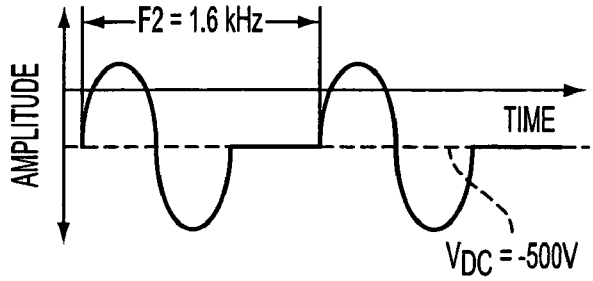
FIGS. 3A–3C are graphs showing various exemplary embodiments of charging results for varying the AC duty cycle obtained from print runs in an exemplary embodiment of an image forming apparatus according to this invention.
Figure 3B:
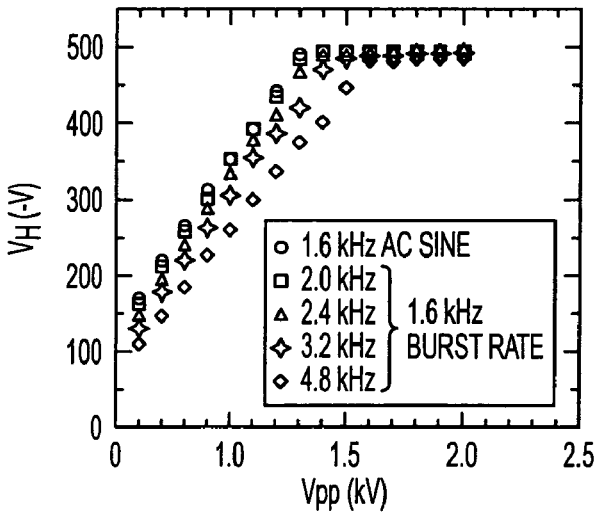
Figure 3C:
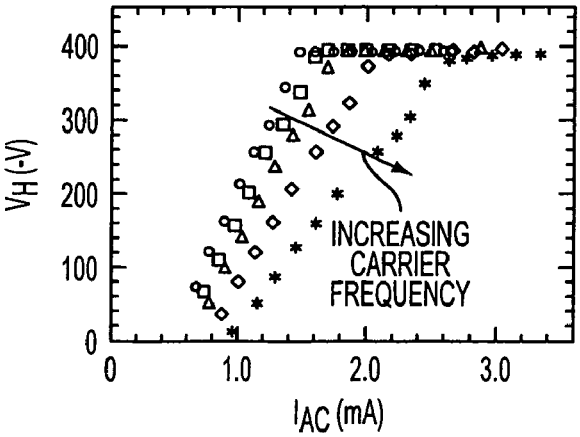

FIGS. 3A–3C are graphs showing various exemplary embodiments of charging results for varying the AC duty cycle obtained from print runs in an exemplary embodiment of an image forming apparatus according to this invention. The Vhi-Vpp and Vhi-IAC characteristics for sinusoidal and burst modulated BCR charging are shown, Vhi also denoted as $V_H$. The open circles in FIGS. 3B and 3C depict sinusoidal BCR charging and the characteristic increase in V-hi with respect to Vpp and IAC, respectively. A leveling off of V-hi above a threshold peak to peak voltage V-th is observed. In various exemplary embodiments BCR charging is done at any Vpp on the plateau of the curve. However, working at a Vpp somewhat greater than V-th may be desirable to eliminate background and improve halftone uniformity. This is referred to as the background disappearance point. For example, the Tokai-2bb BCR has a background disappearing point that is 20–30% higher than V-th.

In various exemplary embodiments, one or both of two methods are used to vary the AC duty cycle and characterize burst modulated BCR charging. Method 1 fixes the burst rate F2 and varies the carrier frequency F1. Method 2 fixes the carrier frequency F1 and varies the burst rate F2. Exemplary results of Method 1 are illustrated in FIGS. 3B and 3C. The open symbols in FIGS. 3B and 3C (excepting the open circles) show the burst modulation charging results when the burst frequency F2 is fixed at 1.6 kHz and the carrier frequency F1 is varied from 2.0–4.8 kHz.

At high duty cycle (e.g., F1=2.0 kHz) the charging behavior approaches that of sinusoidal AC charging. As the carrier frequency increases and duty cycle decreases the charging behavior becomes increasingly non-ideal. At high carrier frequency, e.g. at 4.8 kHz, the charge relaxation time of the BCR limits charging efficiency and a stable V-hi becomes difficult to achieve as indicated in FIGS. 3B and 3C. Moreover, print quality becomes very poor and high background results from the inability to charge to V-hi.

It may be desirable to avoid the use of too high a carrier frequency to achieve low AC duty cycle for these reasons. A practical carrier frequency upper limit for the exemplary Tokai-2bb BCR is about 2.4–3.2 kHz.

Various exemplary embodiments incorporating burst modulation charging waveforms are superior to sinusoidal AC biased waveforms for roll charging. These advantages include the achievement of higher voltages V-hi for lower voltages Vpp and lower currents IAC. By achieving voltages V-hi at lower AC current, the corresponding wear of the photoreceptor is also reduced. Thus, the shifting of the V-hi vs. IAC curves in various exemplary embodiments employing a burst modulated waveform corresponds to appreciable improvements in the wear on the photoreceptor. Further, it is believed that various exemplary embodiments employing a burst rate frequency lower than 1.6 kHz achieve even better reductions in photoreceptor wear. This is shown in greater detail, for example, in the exemplary embodiments of FIG. 4C.

Figure 4A:
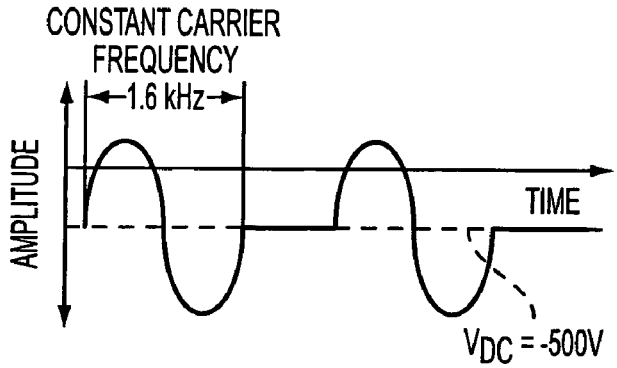
FIGS. 4A–4C are graphs showing various exemplary embodiments of wear results for sinusoidal and burst modulated BCR charging obtained from print runs in an exemplary embodiment of an image forming apparatus according to this invention.
Figure 4B:
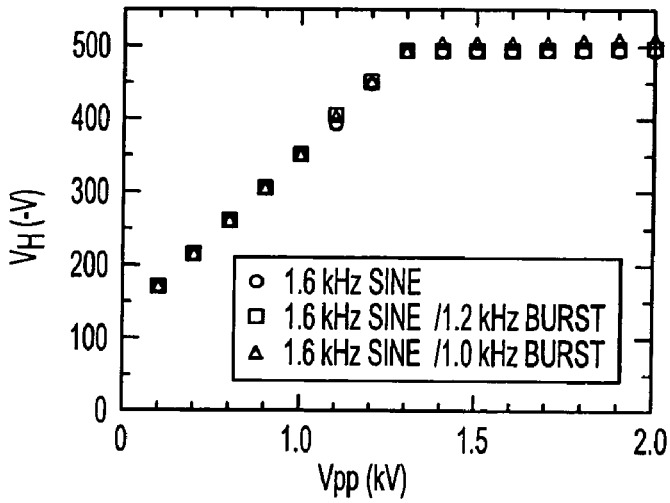
Figure 4C:
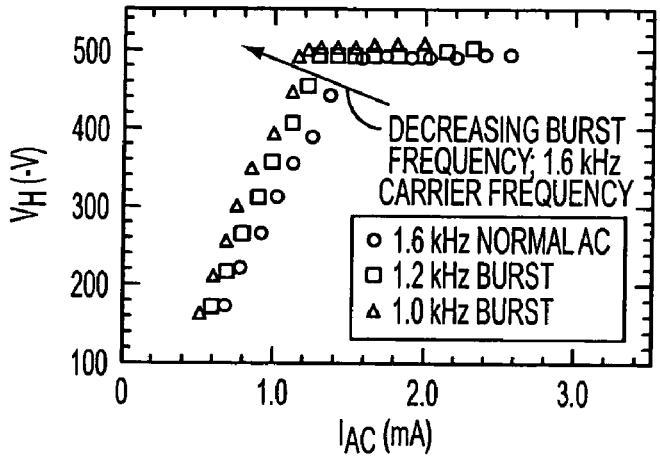

Exemplary charging results for varying the AC duty cycle by Method 2 are shown in FIG. 4. The open circles in FIGS. 4B and 4C, respectively, are exemplary plots of V-hi with respect to V-pp and IAC for sinusoidal AC BCR charging. The open squares and triangles in FIGS. 4B and 4C show the results for exemplary embodiments of burst modulated charging when the carrier frequency F1 is fixed at 1.6 kHz and the burst frequency F2 is decreased from 1.3 to 1.0 kHz (duty cycle decreased from 80% to 63%), respectively. As with exemplary Method 1, here again at high duty cycle the charging characteristics of the exemplary burst modulation waveforms approach that of sinusoidal BCR charging waveforms. However, at a carrier frequency F1=1.6 kHz, the BCR is not relaxation time limited, so increasing the burst frequency has no effect on the V-hi versus Vpp charging curve. In fact, in various exemplary embodiments a beneficial effect on the V-hi versus IAC charging curve occurs because V-th is reduced.

Figure 5:
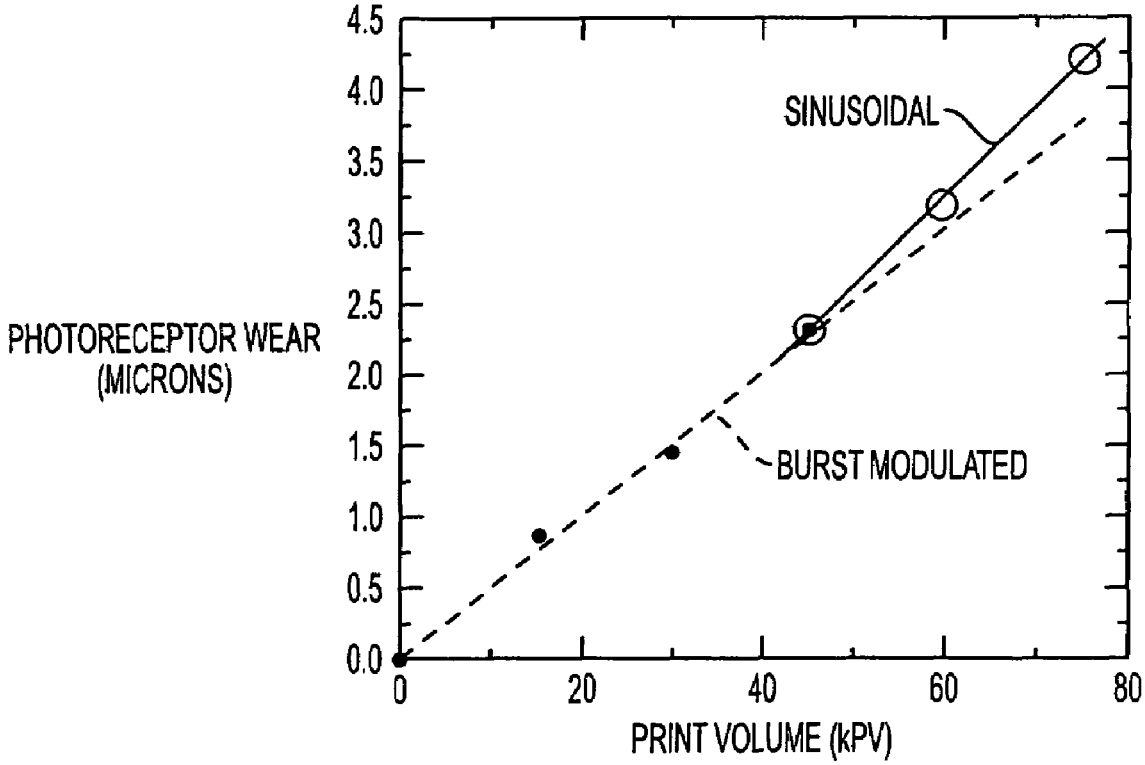
FIG. 5 is a graph showing exemplary embodiments of photoreceptor wear with respect to print volume for sinusoidal and burst modulated waveforms obtained from print runs in an exemplary embodiment of an image forming apparatus according to this invention.

FIG. 5 is an exemplary graph showing the wear results for exemplary sinusoidal and burst modulated BCR charging waveforms obtained from print runs in the exemplary DC12 machine. It is believed that decreasing the AC on time or duty cycle generates on average an associated reduction in the reactive species at the photoreceptor surface. For example, it is believed that reactive radicals and NOx/nitric acid are reduced at the photoreceptor surface in exemplary embodiments employing a decreased AC on time or duty cycle. This also corresponds to an associated decrease in photoreceptor wear.

Common conditions for both exemplary tests are as follows. A Tokai 2-bb BCR is mounted with a 900 gram normal force in a BCR holder retrofitted into the DC12 in an area normally occupied by a wire scorotron. Standard color toner and developer are used. The normal cleaning blade is mounted with 1.1 mm interference and a 22 degree blade set angle. The same drum photoreceptor is used in both tests. All tests are conducted in a lab ambient atmosphere, i.e., 68–70° F. and 30–50% RH. The waveform parameters used in AC sinusoidal BCR charging wear test are F=1.6 kHz, Vdc=−570 V and Vpp=2.0 kV. This results in an AC current of 3.5 mA. The waveform for the corresponding burst modulated BCR charging wear test are F1=1.6 kHz (carrier frequency), F2=1.2 kHz (burst rate) and Vpp=2.0 kV. This results in an IAC=3.0 mA.

New BCRs are used for each exemplary test. Exemplary wear tests are conducted at constant Vpp to study the effect of decreased AC current and duty cycle. The resulting exemplary wear data are plotted in FIG. 5. The initial part of the curve (dashed line) shows wear data obtained during the exemplary burst modulated BCR charging. The second part of the curve exhibiting higher slope is the wear data obtained by AC sinusoidal BCR charging. Wear rates of 51 nm/kprint (kPV or thousands of pages printed), and 63 nm/kprint are calculated for the exemplary burst modulated and sinusoidal BCR charging, respectively. This corresponds to an exemplary wear rate improvement of 23% with the exemplary burst modulated waveform.

It is believed that other exemplary embodiments decreasing the duty cycle from the 75% value in the above-described exemplary wear tests to, for example, 50% would improve the wear rate even further. This wear improvement would not come at the expense of print quality because, as shown below, halftone uniformity and background are acceptable at an exemplary 50% duty cycle. In terms of BCR contamination, no significant differences in the levels of contamination are observed between BCRs used in the exemplary burst modulated and sinusoidal AC wear tests described above after 30–45 kiloprints. It is believed that the continuous application of AC, even at low duty cycle, is sufficient to remove charged contamination from the surface.

In various exemplary embodiments print quality is screened as a function of AC duty cycle. In virtually all exemplary cases, no degradation relative to sinusoidal AC BCR charging is observed in print quality attributes such as halftone uniformity, background and line density. The table in FIG. 6 summarizes the exemplary benefits. Exemplary test conditions include Vdc=−570 V, Vpp=2.0 kV (constant voltage). The exemplary photoreceptor used is a PTFE filled OPC.

Given a constant burst frequency of 1.6 kHz, variation in carrier frequency from 2.0 to 3.2 kHz (80% and 50% duty cycles, respectively) led to print quality that is equivalent to sinusoidal AC BCR charging. However, with the exemplary carrier frequency increased to 4.8 kHz (33% duty cycle), print quality is characterized by severe background. It is believed that this occurs because the relaxation time limitations of the exemplary BCR prohibit attainment of V-hi.

Print quality is also generally good with an exemplary fixed 1.6 kHz carrier frequency and burst frequency varying from 1.3 to 1.0 kHz (80% and 63% duty cycles, respectively). At exemplary 1.6 kHz charging is not limited by BCR relaxation time limitations. Thus, burst frequencies lower than 1 kHz may be desirable.

It is believed that the lower limit of burst frequency is dictated by the onset of banding in the prints. It is believed that the optimized values of the burst frequency would depend on process speed and the electrical properties of the BCR such as relaxation time.

The use of low AC duty cycles is also expected to increase the process speed limit of BCR charging. Exemplary BCR charging with excellent print quality at 48 pages per minute (ppm) in the exemplary DC12 is achieved, even in C-zone. It is believed that burst modulation charging may extend the process speed limit even higher, perhaps as high as 60 ppm, particularly in exemplary embodiments where low duty cycles and conductive BCRs are used.

The lower limit on duty cycle is believed to be bounded only by the desired image quality. For example, in various exemplary embodiments, it may not be desirable to reduce the duty cycle below the point at which banding of the resulting image is observed. However, it may be preferable to reduce the duty cycle to the lowest possible level achievable without an observable degradation of the desired image quality. In other words, it is believed that the reduction in the wear on the photoreceptor reaches a functional maximum at a user determined threshold where image quality is affected.

Other factors that may affect the lower limit of the duty cycle include the material from which the bias charging roller is made. Some bias charging rollers may be constructed of a material unable to respond to the frequency of the charging wave beyond some lower duty cycle threshold.

It is believed that this is true because the frequency response associated with the resistivity of the material from which the BCR is constructed corresponds to a lower achievable limit on the duty cycle.

In various exemplary embodiments the burst modulation waveform is applied to other embodiments of contact charging members including blade, film, belt, tube, magnetic brush chargers, and so on. Finally, in various exemplary embodiments the waveform is not sinusoidal, but of another generalized nature including, for example, a rectangular or a triangular wave.

In recapitulation, various exemplary embodiments include a charging system wherein, as distinguished from clipped or pulsed bias BCR waveforms, a burst modulation BCR charging waveform is used. This has the desired electrical characteristics of other forms of BCR charging, including a stable V-hi (independent of Vpp and IAC) and the ability to set V-hi via the DC offset bias. However, burst modulation BCR charging is able to, without adversely affecting print quality, decrease photoreceptor wear. In various exemplary embodiments, this is achieved by reducing the AC duty cycle and AC current. In various exemplary embodiments significant wear reductions are achievable with even lower duty cycle waveforms. This exemplary technique is fairly insensitive to contamination. Finally, in various exemplary embodiments, burst modulated BCR charging extends BCR charging to even higher process speeds.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of operating an electrostatographic printing apparatus, comprising:

applying an electrical bias to a charge-retentive member of the electrostatographic printing apparatus, said charge-retentive member defining an image surface, the electrostatographic printing apparatus further including a charging device for placing a charge on the imaging surface, a gap existing between the imaging surface and the charging device, said applying including generating a burst modulated waveform, wherein the generating includes employing a DC offset superimposed on an AC waveform, and the applying includes generating a first AC waveform carrier frequency over a time $t_1$ during which the AC waveform is gated on and a second AC waveform burst frequency over a time $t_2$ during which the AC waveform is gated on and off, wherein the average AC current over time $t_2$ is less than the AC current over time $t_1$.

2. The method of claim 1, wherein the generating includes fixing a burst rate to constant frequency and varying a carrier frequency.

3. The method of claim 1, wherein the generating includes fixing a carrier frequency to constant frequency and varying a burst rate.

4. The method of claim 1, wherein the generating includes modifying a waveform selected from the group consisting of sinusoidal, rectangular, and triangular.

5. The method of claim 2, wherein the generating includes employing a carrier frequency between 500 and 5000 Hertz.

6. The method of claim 1, wherein the generating includes employing a burst rate between 250 and 4000 Hertz.

7. The method of claim 1, wherein the generating includes employing a AC voltage between 1000 Vpp and 3000 Vpp.

8. The method of claim 1, wherein the generating includes employing a duty cycle between 10% and 99%.

9. A method of charging a charge-retentive member of an electrostatographic printing apparatus, comprising:

applying an electrical bias from a charging member of the electrostatographic printing apparatus to an imaging surface of the charge-retentive member, a gap existing between the imaging surface and the charging device, said applying including generating a burst modulated waveform, wherein the generating includes employing a DC offset superimposed on an AC waveform, and the applying includes generating a first AC waveform carrier frequency over a time $t_1$ during which the AC waveform is gated on and a second AC waveform burst frequency over a time $t_2$ during which the AC waveform is gated on and off, wherein the average AC current over time $t_2$ is less than the AC current over time $t_1$.

10. The method of claim 9, wherein the generating includes fixing a burst rate to constant frequency and varying a carrier frequency.

11. The method of claim 9, wherein the generating includes fixing a carrier frequency to constant frequency and varying a burst rate.

12. The method of claim 9, wherein the generating includes modifying a waveform selected from the group consisting of sinusoidal, rectangular, and triangular.

13. The method of claim 10, wherein the generating includes employing a carrier frequency between 500 and 5000 Hertz.

14. The method of claim 9, wherein the generating includes employing a burst rate between 250 and 4000 Hertz.

15. The method of claim 9, wherein the generating includes employing a AC voltage between 1000 Vpp and 3000 Vpp.

16. The method of claim 9, wherein the generating includes employing a duty cycle between 10% and 99%.

* * * * *